United States Patent [19]

Nomura

[11] Patent Number: 4,479,565

[45] Date of Patent: Oct. 30, 1984

[54] CONTROL APPARATUS FOR A.C. ELEVATOR

[75] Inventor: Masami Nomura, Nagoya, Japan

[73] Assignee: Mitsubishi Denki Kabushiki Kaisha, Tokyo, Japan

[21] Appl. No.: 403,874

[22] Filed: Jul. 30, 1982

[30] Foreign Application Priority Data

Aug. 4, 1981 [JP] Japan ..... 56-122114

[51] Int. Cl.[3] ..... B66B 1/32

[52] U.S. Cl. ..... 187/29 R; 318/757

[58] Field of Search ..... 187/29; 318/803, 807, 318/757

[56] References Cited

U.S. PATENT DOCUMENTS 4,209,082 6/1980 Anzai et al. ..... 187/29

4,227,138 10/1980 Espelage et al. ..... 318/807 X 4,319,177 3/1982 Kawada et al. ..... 318/803 X

FOREIGN PATENT DOCUMENTS 56-132275 10/1981 Japan .

*Primary Examiner*—J. V. Truhe

*Assistant Examiner*—W. E. Duncanson, Jr.

*Attorney, Agent, or Firm*—Wenderoth, Lind & Ponack

[57] ABSTRACT

Described is a control device for an a.c. elevator wherein the a.c. voltage from the commercial a.c. source is rectified by a rectifier device, the thus rectified voltage is converted by an inverter into an a.c. power of variable frequency and variable phase order, and an a.c. motor is driven by this a.c. power for driving the elevator car, characterized in that electrical contacts are inserted between said a.c. source and said rectifier so as to be closed and opened at the time of start and stop of the elevator car, respectively.

5 Claims, 9 Drawing Figures

CONTROL APPARATUS FOR A.C. ELEVATOR

BACKGROUND OF THE INVENTION

This invention relates to an improved control device for an elevator driven by an a.c. motor.

According to a known device of this kind, an elevator car is driven by an induction motor to which a current is supplied from an alternating current source of variable voltage and frequency to effect speed control of the motor. This known device is shown in FIG. 1.

In FIG. 1, the numeral 1 designates a rectifier device connected to a three-phase a.c. source R, S, T. The numeral 2 denotes an inverter formed e.g. by thyristors connected to the d.c. side of the rectifier device 1 and designed to convert the direct current into the alternating current with variable voltage and frequency in the manner known per se. The numeral 3 designates a three-phase induction motor driven by the inverter 2. The numeral 4 designates a brake wheel coupled to the motor 3. The numeral 5 designates a brake shoe mounted opposite to the outer periphery of the brake wheel 4 for braking the brake wheel 4 under the force of a spring, not shown. The numeral 6 designates a brake coil adapted when energized to disengage the brake shoe 5 from the brake wheel 4 against the force of the spring. The numeral 7 designates a driving sheave of a winch driven by the motor 3. The numeral 8 designates a main cable wound about the sheave 7. The numeral 9 designates a car coupled to the cable 8, and the numeral 10 a counterweight. The numerals 11*a* to 11*c* designate contacts of a magnetic contactor for ascent which is inserted between the inverter 2 and the motor 3 and closed when the car 9 travels towards above. The numeral 11*d* designates a contact of the magnetic contactor connected to the brake coil 6 and operating in the same manner as the contacts 11*a* to 11*c*. The numerals 12*a* to 12*c* designate contacts of a magnetic contactor for descent which is inserted between the inverter 2 and the motor 3 and closed when the car 9 travels towards below. The numeral 12*d* designates a contact of the magnetic contactor for descent connected in parallel with the contact 11*d* and operating in the same manner as the contacts 12*a* to 12*c*. The numeral 13 designates a direct current source connected across contacts 11*d*, 12*d* and brake coil 6.

In operation, while the car 9 is at a standstill, brake shoe 5 is pressured to the brake wheel 4 under the force of the spring. Since the cage 9 travels towards above, when the contact 11*d* of the magnetic contactor for ascent is closed, the brake coil 6 is energized and the brake shoe 5 is disengaged from the brake wheel 4. Simultaneously, the contacts 11*a* to 11*c* are closed, so that the a.c. power of variable frequency supplied as output from the inverter 2 is supplied to the motor 3. In this manner, the motor 3 is started, and the car 9 travels towards above. The a.c. power is controlled in frequency by the inverter 2 for controlling in turn the r.p.m. of the motor 3 and hence the travel speed of the car 9. When approaching the floor of destination, the cage 9 starts to be showed down.

The contacts 11*a* to 11*c* are opened shortly before the car gets to the floor of destination. Thus, the source is dis-connected from the motor 3. Simultaneously, the contact 11*d* is opened to deenergize the brake coil 6, so that the brake shoe 5 is pressured to the brake wheel 4 under the force of the spring. In this manner, the car 9 is brought to a stop. The car 9 may travel towards below in the similar manner as mentioned above.

It is required of an elevator to be operated smoothly and with a higher operating efficiency since the time of start until halt thereof through high speed travel and slowdown. Hence, the alternating current of the extremely low frequency must be supplied to the motor 3 at the start and shortly before the car comes to a standstill. On the other hand, the braking characteristics of the contacts 11*a* to 11*c* and 12*a* to 12*c* are such that the breakable current capacity is lowered with the decrease in frequency. In this consequence, when the frequency is lowered, a larger magnetic contactor must be used, even when the current intensity remains the same. Moreover, in case of a trouble of the inverter 2, a large direct current may flow through the motor 2. After all, the motor 3 must be able to be disengaged positively from the source at any power source frequency for assuring utmost safety of elevator operation. Hence, the contact is required to have a larger breaking capacity. In addition, it is necessary to provide two sets of contacts 11*a* to 11*c* and 12*a* to 12*c*, which means additional costs.

SUMMARY OF THE INVENTION

It is therefore on object of the present invention to provide a control device for an a.c. elevator which is free from the aforesaid deficiency and in which the contacts of the magnetic contactor may have a smaller breaking capacity and utmost safety may be assured by using a single set of the contacts for the travel towards above and towards below of the elevator car. The present invention resides in a control device for an a.c. elevator wherein the a.c. voltage from the commercial a.c. source is rectified by a rectifier device, the thus rectified voltage is converted by an inverter into an a.c. power of variable frequency and variable phase order, and an a.c. motor is driven by this a.c. power for driving the elevator car, characterized in that electrical contacts are inserted between said a.c. source and the rectifier device so as to be closed and opened at the time of start and stop of the elevator car, respectively.

DESCRIPTION OF THE PREFERRED EMBODIMENTS

Figure 2:
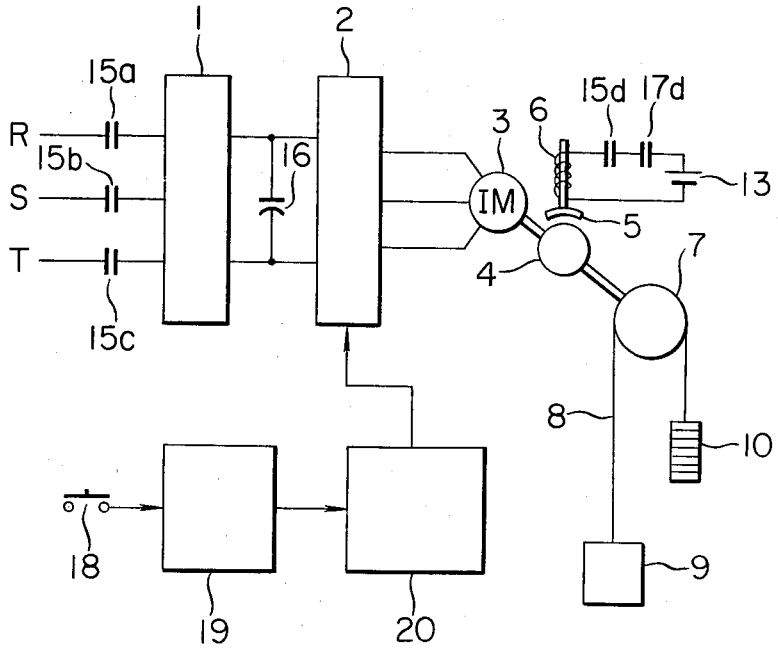
FIG. 2 is a diagrammatic view showing a control device for the a.c. elevator according to an embodiment of the present invention.

FIG. 2 illustrates a preferred embodiment of the present invention.

Figure 1:
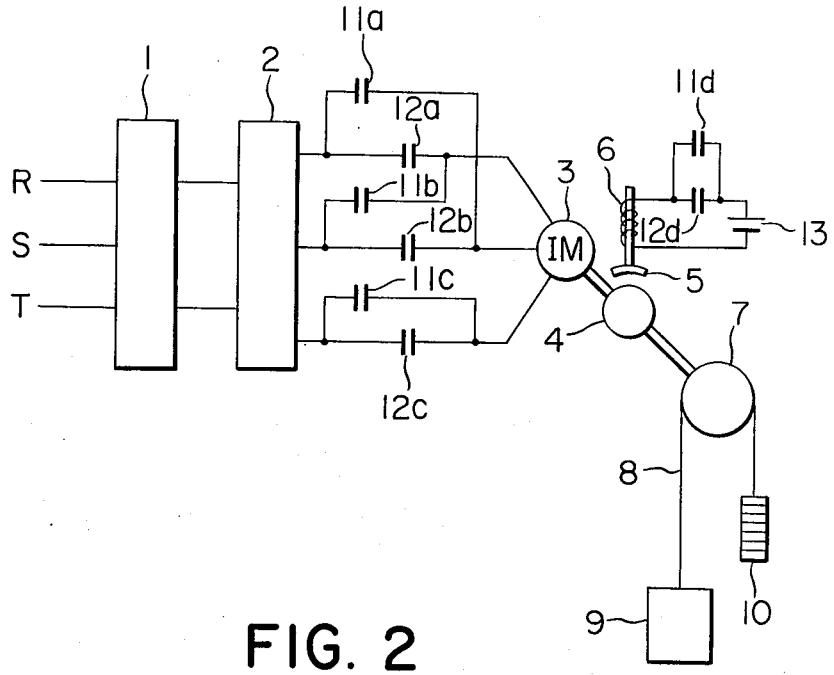
FIG. 1 PRIOR ART
FIG. 1 is a diagrammatic view showing the conventional control device for the a.c. elevator.

In FIG. 2, the numerals 15*a* to 15*c* designate contacts of a magnetic contactor connected between an electric source R, S, T and a rectifier 1 and adapted to be closed and opened respectively when the car 9 is moved and comes to a standstill. The numeral 15*d* designates a contact of the magnetic contactor connected to the brake coil 6 and operable in the same manner as contacts 15*a*to 15*c*. The numeral 16 designates a capacitor connected across output wires of the rectifier device 1. The numeral 17*d* designates a contact of the magnetic contactor connected in series with the contact 15*d* and adapted to be closed and opened after the contact 15*d* is closed and opened, respectively. The numeral 18 designates calling or demand buttons such as calling or demand buttons on the floor and destination buttons in the car. The numeral 19 designates a unit for generating driving command and direction command, and the numeral 20 designates a unit for generating frequency control command and phase order change command. Other members are the same as those shown in FIG. 1.

The control device of the present embodiment operates as follows.

Upon actuation of a demand button 18, the unit 19 for generating driving and direction commands are activated, so that the contacts 15*a* to 15*c* are closed and the rectifier 1 delivers a d.c. output signal. When the capacitor 16 has been charged to a predetermined potential, control arms, not shown, of the respective inverter arms are rendered operative sequentially depending on the prevailing car direction. The inverter delivers an a.c. output signal of variable voltage and frequency and phase order corresponding to the prevailing car direction in accordance with instructions issued by the unit 20.

The contact 15*d* is also closed, and thereafter the contact 17*d* is also closed. At this time, the inverter 2 starts to issue an a.c. output signal. The brake coil 6 is energized in this manner and the car 9 starts its travel. The frequency of the a.c. output signal is controlled by the commands from the unit 20 for controlling the speed of the car 9. As the car 9 is slowed down and approaches the floor of destination, the contacts 15*a* to 15*d* are opened. With the contact 15*d* opened, the brake coil 6 is deenergized and the braking force is applied to the brake wheel 4. Simultaneously, with the contacts 15*a* to 15*c* opened as mentioned above, the rectifier device 1 is disconnected from the source R, S, T and only the control elements of predetermined inverter arms are closed. As a result, the charge stored in the capacitor 16 flows to the motor 3 and a d.c. braking torque is applied to the motor 3. This is effective to stop the car 9 instantly in case of an emergency.

Since the contacts are connected on the side of the source R, S, T of the rectifier device 1, only the current of the commercial frequency need be interrupted and the breaking capacity of the contacts 15*a* to 15*c* and hence the size of the magnetic contactor may be reduced. Moreover, since direction commands for descent or ascent may be issued by changeover of the firing order of the control elements of the inverter arms, it is only necessary to provide a single set of contacts 15*a* to 15*c*.

Figure 3:
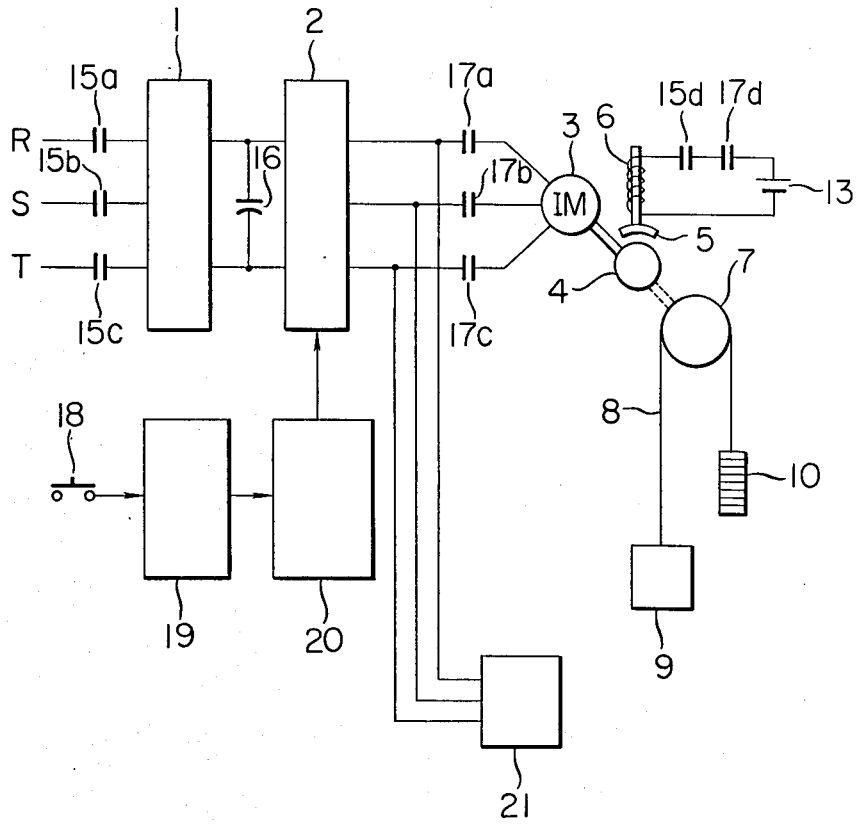
FIG. 3 is a diagrammatic view showing a modification.

FIG. 3 shows a modified embodiment of the present invention.

In FIG. 3, the numerals designate contacts of a magnetic contactor connected between the inverter 2 and the motor 3 and operating in the same manner as the contact 17*d*. The numeral 21 designates a monitor device connected to the output side of the inverter 2 for detecting abnormal conditions in the magnitude or waveform of the output voltage from the inverter 2. Other members are shown by using the same numerals as those shown in FIG. 2.

In operation, upon closure of the contacts 15*a* to 15*c* and energization of the inverter 2, the output of the inverter 2 is checked by the monitor unit 21. In case of no abnormalities in the inverter output, the contacts 17*a* to 17*d* are closed to start the car 9 so that utmost safety may be assured. When the car is to be halted, the contacts 15*a* to 15*d* are opened to disconnect the motor 3 from the source R, S, T, at the same time that the current supply to the brake coil 6 is interrupted. The contacts 17*a* to 17*d* are then opened with a certain time delay. Since the contacts 17*a* to 17*d* are opened in this manner after the current flowing therethrough has decreased sufficiently the breaking capacity of the contacts 17*a* to 17*c* and the size of the associated magnetic contactor may be reduced.

Reference is made to detailed circuit diagrams for illustration of the present embodiment.

Figure 4:
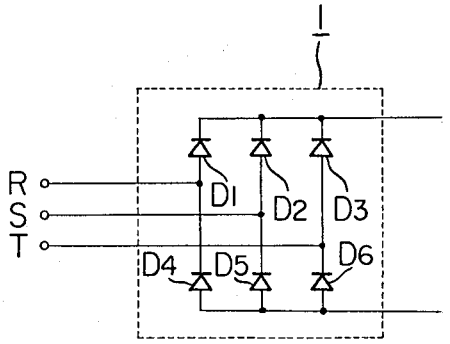
FIG. 4 is a circuit diagram showing the rectifier 1.
Figure 5:
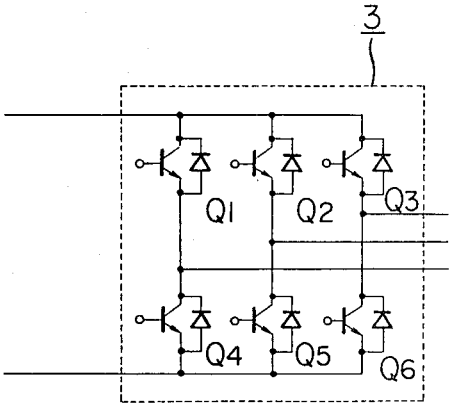
FIG. 5 is a schematic circuit diagram of the inventer 3.

FIG. 4 shows the inside connection of the rectifier, wherein $D_1$ to $D_6$ designate diodes. The output of the rectifier is supplied to the inverter 2 shown in FIG. 5, wherein $Q_1$ to $Q_6$ designated transistors each associated with a diode having an opposite polarity to the direction of the transistor emitter to collector current. The respective output wires of the inverter are energized sequentially in accordance with the desired car direction by the control currents applied to the base electrodes of the transistors.

Figure 6:
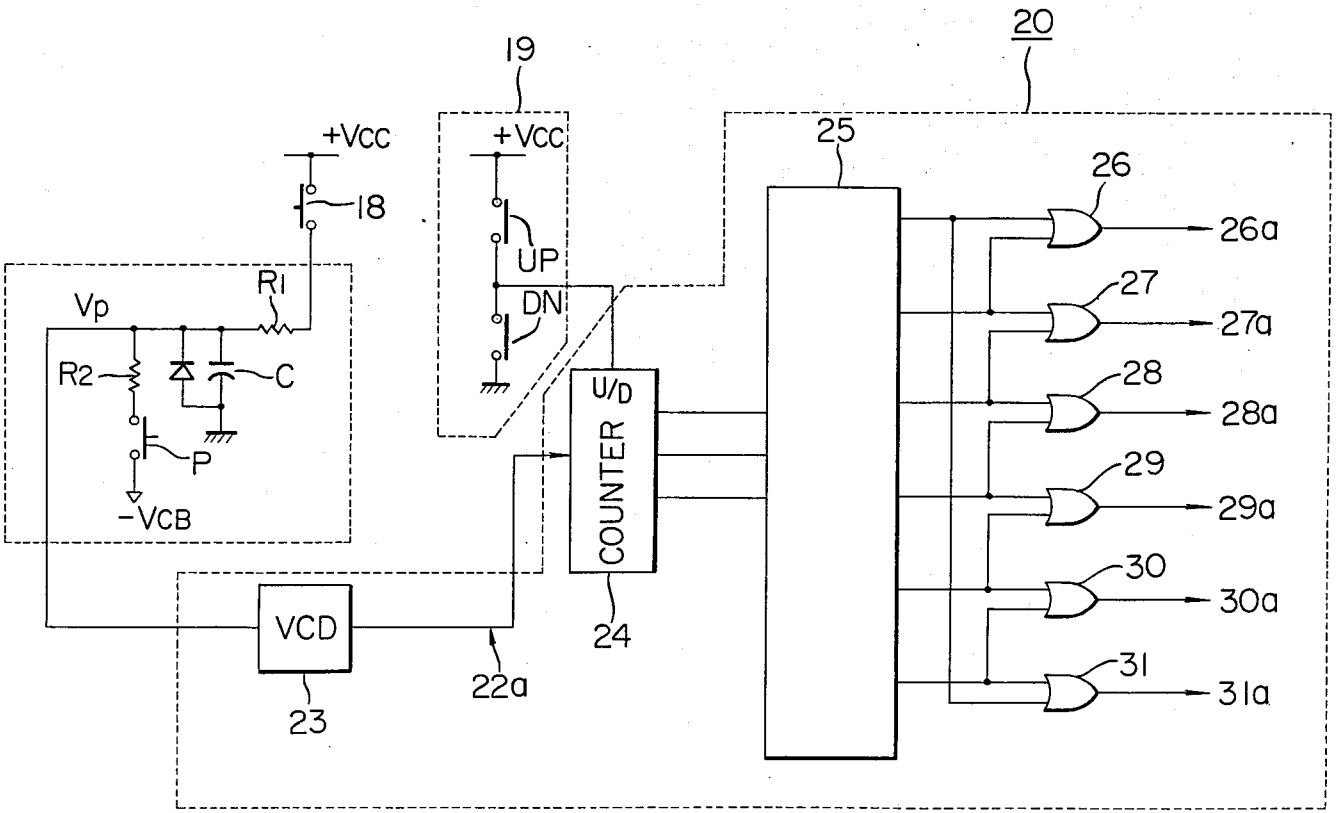
FIG. 6 is a detailed circuit diagram of the control device shown in FIG. 3.

FIG. 6 is a circuit diagram showing an embodiment of the demand button 18, car direction command generator 19 and frequency and phase order signal generator 20.

Figure 7:
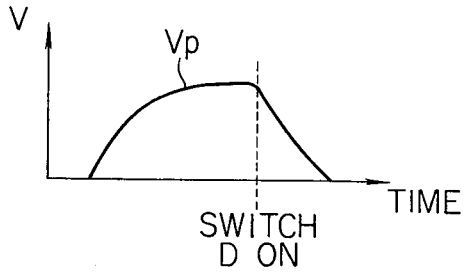
FIG. 7 shows waveforms of the charge voltage Vp.

In FIG. 6, upon actuation of the demand button 18, source voltage Vcc is applied to a speed pattern circuit SP for charging a capacitor C via resistor R1. FIG. 7 shows a charge voltage VP. This charge voltage VP resulting from actuation of the demand button 18 is applied to a voltage controlled oscillator 23, from which an output pulse 22*a* corresponding to the charge voltage VP is produced.

Figure 8:
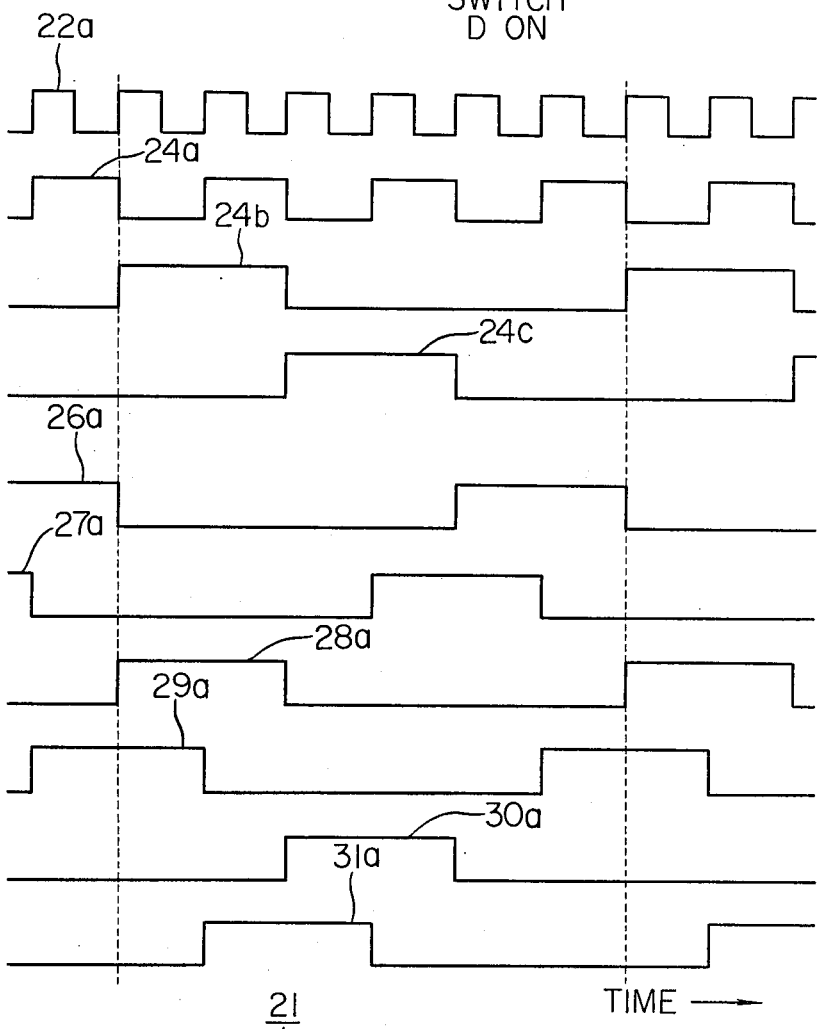
FIG. 8 shows output pulse waveforms at various circuit points shown in FIG. 6.

FIG. 8 shows output pulse waveforms at various circuit points shown in FIG. 6. The output pulse 22*a* is supplied to a 6-step up/down counter 24, from which output pulses shown at 24*a*, 24*b*, 24*c* in FIG. 8 are generated for controlling the inverter 2.

The counter 24 also receives car direction command signals from the car direction command generator 19. Thus, when a contact UP is closed, source voltage Vcc is applied to the counter 24 for rotating the motor 3 in a direction in which the elevator car travels towards above. When a contact DN is closed, the elevator car travels towards below.

Thus, output pulses 26*a* to 31*a* shown in FIG. 7 are delivered from OR gates 26 to 31 and applied as gate pulses to the transistors $Q_1$ to $Q_6$ of the inverter 2 so that the a.c. output of the variable voltage and frequency is generated from the inverter 2 according to the phase order corresponding to the prevailing car direction.

Figure 9:
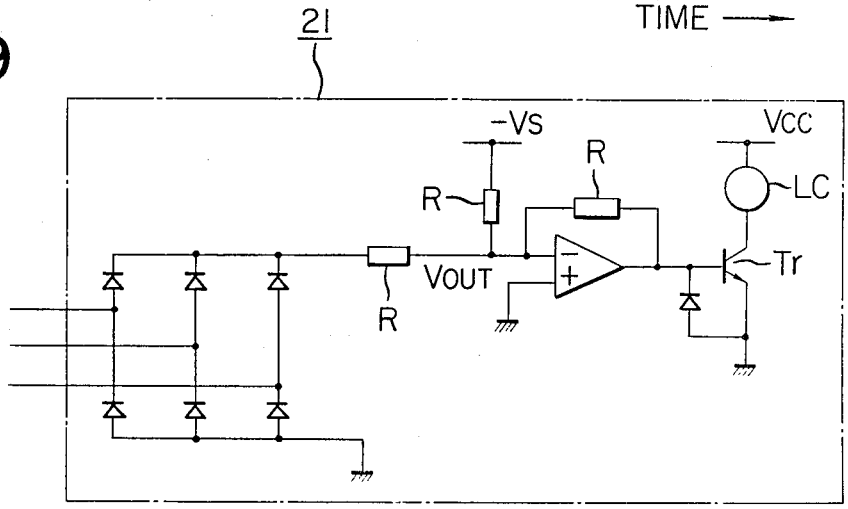
FIG. 9 is a detailed circuit diagram of the monitoring unit 20.

FIG. 9 shows an embodiment of the monitor unit 21 shown in FIG. 3. In FIG. 9, the output voltage of the inverter 2 is rectified by a diode rectifier for generating a rectified voltage Vout which is then applied to a transistor Tr. When the rectified voltage Vout is above a threshold value $|Vs|$, The transistor Tr is turned off. When the voltage Vout is below $|Vs|$, the transistor is turned on and the current flows through a relay coil LC to open the contacts 17*a* to 17*d* to stop the elevator as an emergency or abnormal condition.

As mentioned above, the present invention provides a system for driving an elevator car by an a.c. power which is obtained by conversion by an inverter from a rectified current supplied from the commercial supply source. Electrical contacts are connected between the commercial supply source and the rectifier device so as to be closed and opened when the car is started and stopped, respectively. In this manner, only a single set of contacts with small breaking capacity need be employed for both ascent and descent of the elevator car, thus reducing the manufacture costs and assuring utmost safety in stopping the car.

I claim:

1. A control device for controlling an A.C. elevator comprising:

a commercial A.C. voltage source;

a rectifier device for rectifying a voltage output from said commercial A.C. source;

a capacitor for smoothing a rectified output voltage of said rectifier device;

an inverter for converting a smoothed output voltage from said capacitor into an A.C. voltage with a variable frequency;

an A.C. motor for driving an elevator car with the A.C. voltage thus converted by said inverter;

a brake means for braking A.C. motor, said brake means having an electrical circuit for controlling its braking operation;

electrical contacts connected between said commercial A.C. source and said rectifier, said contacts being respectively closed and opened at the time of starting and stopping said elevator car; and at least one contact provided in said electrical circuit of said brake means which is interlocked with said electrical contacts so as to operate therewith.

2. A control device as claimed in claim 1, wherein said contacts are contacts of a single magnetic contactor which is used for both ascent and descent of said elevator car.

3. A control device as claimed in claim 1, wherein said inverter generates an A.C. voltage of variable voltage and frequency in accordance with the phase order corresponding to the car direction.

4. A device for controlling an a.c. elevator comprising:

a commercial a.c. source;

a rectifier device for rectifying the voltage from the commercial a.c. source;

a capacitor for smoothing the output voltage of the rectifier;

an inverter for converting the smoothed output voltage of the capacitor into an a.c. power of variable frequency;

an a.c. motor for driving the elevator car by the a.c. power thus converted by the inverter;

electrical contacts connected between said commercial a.c. source and said rectifier device and adapted to be closed and opened at the time of start and stop of the elevator car, respectively;

a monitor unit connected to the output side of the inverter for detecting abnormalities in the output voltage from the inverter; and further electrical contacts connected between the inverter and the a.c. motor and closed responsive to the output signal from said monitoring unit.

5. The control device as claimed in claim 4, wherein said monitoring unit has its contact closed at the start of the elevator car and monitors the inverter output when the inverter is activated.

* * * * *